United States Patent [19]

Block

[11] Patent Number: 4,766,826

[45] Date of Patent: Aug. 30, 1988

[54] SMALL PART FEEDING AND INSERTING SYSTEM

[75] Inventor: Charles Block, North Bellmore, N.Y.

[73] Assignee: Joseph Galkin Corporation, Hicksville, N.Y.

[21] Appl. No.: 43,281

[22] Filed: Apr. 27, 1987

Related U.S. Application Data

[63] Continuation of Ser. No. 910,592, Sep. 23, 1986, Pat. No. 4,682,556.

[51] Int. Cl.[4] ..... D05B 21/00; D05B 97/00

[52] U.S. Cl. ..... 112/265.1; 112/121.12; 112/113

[58] Field of Search ..... 112/265.1, 265.2, 262.3, 112/121.11, 121.12, 121.15, 102, 104, 113

[56] References Cited

U.S. PATENT DOCUMENTS

| | | | |
|---|---|---|---|
| 3,170,423 | 2/1965 | Hewebry | 112/121.12 |
| 3,358,626 | 12/1967 | Bryan | 112/121.12 |
| 3,448,705 | 6/1969 | Scherr et al. | 112/121.12 |
| 3,474,747 | 10/1969 | Noiles | 112/121.12 |
| 3,543,737 | 12/1970 | Maschmann | 112/102 X |
| 3,769,924 | 11/1973 | Rogers et al. | 112/121.12 X |
| 4,425,858 | 1/1984 | Hargett | 112/121.15 X |

*Primary Examiner*—H. Hampton Hunter

*Attorney, Agent, or Firm*—Paul J. Sutton

[57] ABSTRACT

The present invention teaches a system, including novel apparatus and novel method, which is capable of feeding or delivering and inserting relatively small parts to a sewing or joining station. By the term small parts it is contemplated that the system according to the present invention feed and insert items such as, but not limited to, apparel labels and strips of hooks and/or loops available from the Velcro company. These small parts are either fed from a magazine or stacking chamber where individual pre-cut parts are stacked or, in the alternative, a relatively continuous strip or roll of the material to be fed is cut in predetermined lengths. More specifics of the system will become apparent from the annexed specification and drawings.

2 Claims, 18 Drawing Sheets

FIG. 2
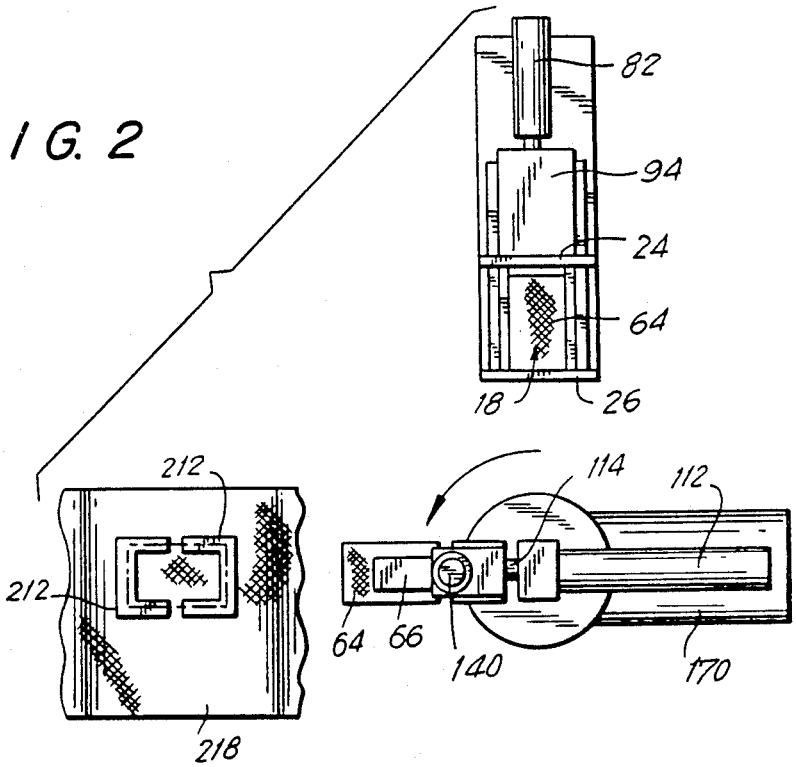
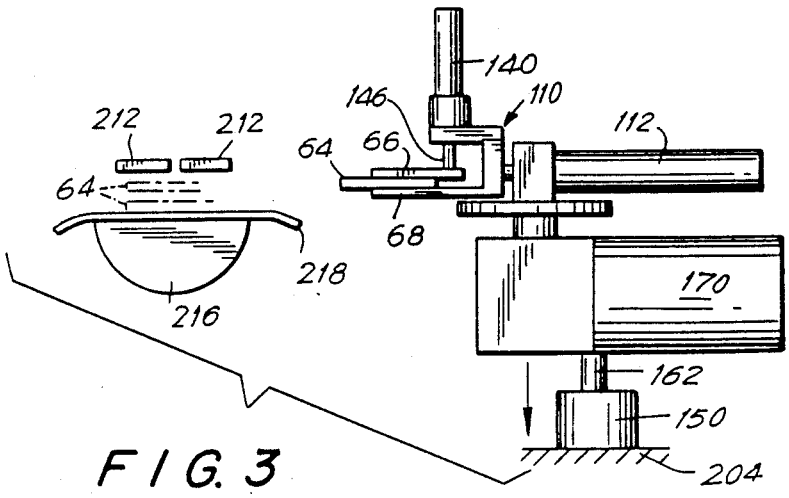
FIG. 3

FIG. 4
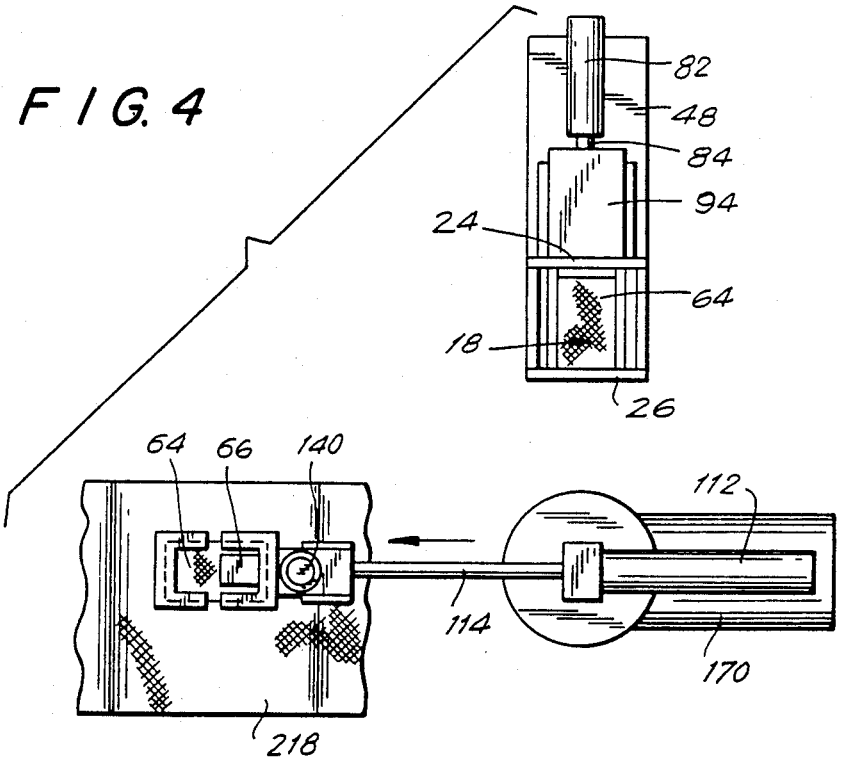
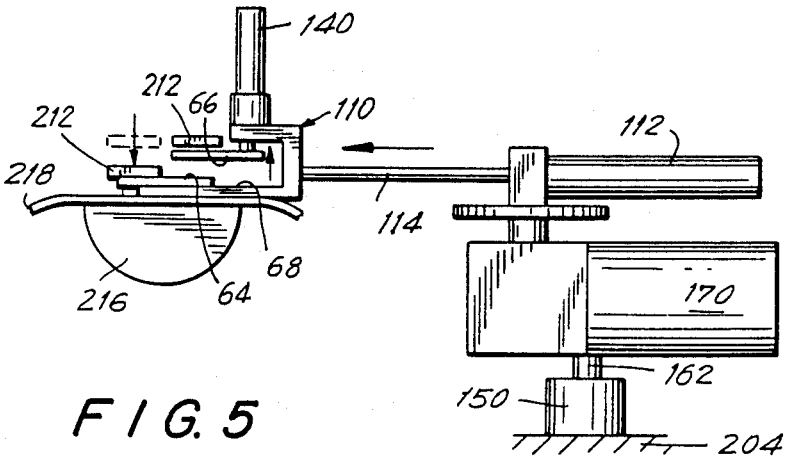
FIG. 5

FIG. 6
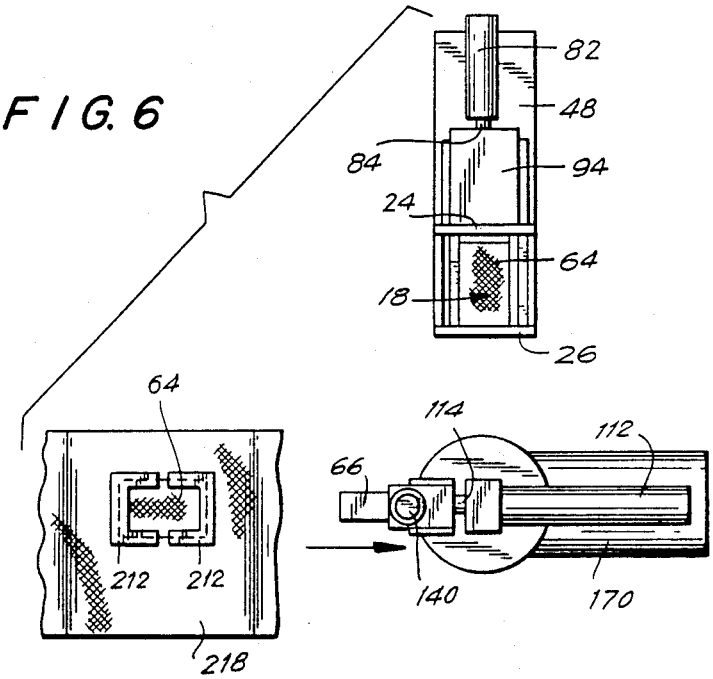
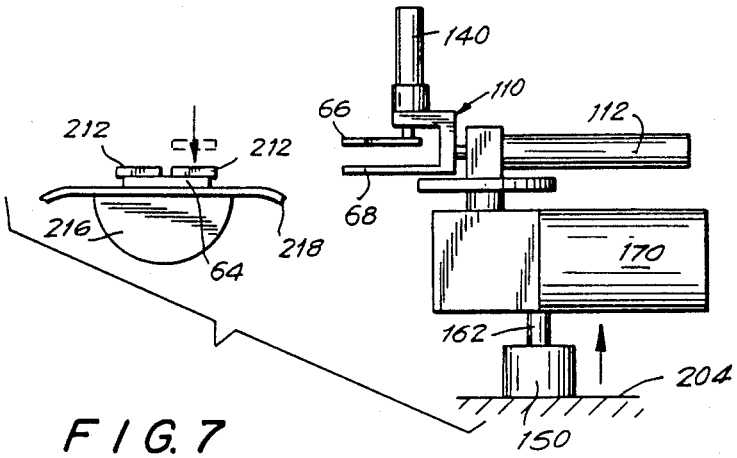
FIG. 7

SMALL PART FEEDING AND INSERTING SYSTEM

CROSS-REFERENCE TO RELATED APPLICATION

This application is a continuation of patent application Ser. No. 910,592 filed Sept. 23, 1986, which has issued to U.S. Pat. No. 4,682,556 dated July 28, 1987.

The present invention relates to sewing and joining apparatus and, more specifically, to a system for for feeding and inserting relatively small parts or items to a sewing or joining location.

A need exists for the reliable and rapid delivery of relatively small parts, such as labels or hook/loop or any other material, to the station or location of sewing or joining apparatus, such as, without limitation, a sewing machine. For convenience and by way of example only, the present specification will describe the novel system according to the present invention for use in a sewing machine environment. However, the reader is cautioned that it is contemplated by the present invention that items may be fed and inserted to areas or stations where any number of a variety of operations may be performed upon them. For example, heat or sonic welding or chemical adhesive or any other type of joining methods may be so employed upon the part fed and inserted to the desired zone. In addition, while the present specification will give examples of fabric material to be fed to a sewing zone where they are sewn to material that may comprise clothing, it is contemplated that materials other than fabrics may be fed and inserted into an appropriate zone without departing from the spirit and scope of the present invention.

It is an object of the present invention to provide a system capable of positively and efficiently feeding and inserting relatively small parts such as tape, velcro, labels, etc. to a joining zone, such as that of a commercial sewing machine, and wherein the operator is able to see and examine the small part at all times during the operation(s).

It is another object of the present invention to provide such a system, as aforesaid, wherein the steps thereof are performed automatically, thereby enabling the sewing machine operator to have to handle only the garment or item to which the small part is to be joined.

It is yet another object of the present invention to provide such a system, wherein there is a choice of utilizing either a supply of continuously fed and cut stock or a supply of precut items to be sewn, such as labels or the like.

It is a further object of the present invention to provide such a system, wherein automatic feeding, cutting and positioning of the item to be joined occurs during the sewing cycle of the previously positioned item.

It is yet another object of this invention to provide such a system, wherein the feeding and inserting apparatus of the present system may be adapted to any converted bar tacker, and wherein the user may have a choice of a variety of predetermined stitch patterns.

Still another object of the present invention is to provide such a system, wherein the joining machine operator may control the entire feeding and inserting operation with a single foot pedal, including the ability to abort where necessary or desirable.

Other objects of the present invention will become apparent from a reading of this specification, taken in conjunction with the drawings, wherein:

FIGS. 2–11 are a series of partial schematic and partial fragmentary realistic views of apparatus according to the present invention, wherein sequential steps of feeding and insertion of the small parts are illustrated;

Figure 1:
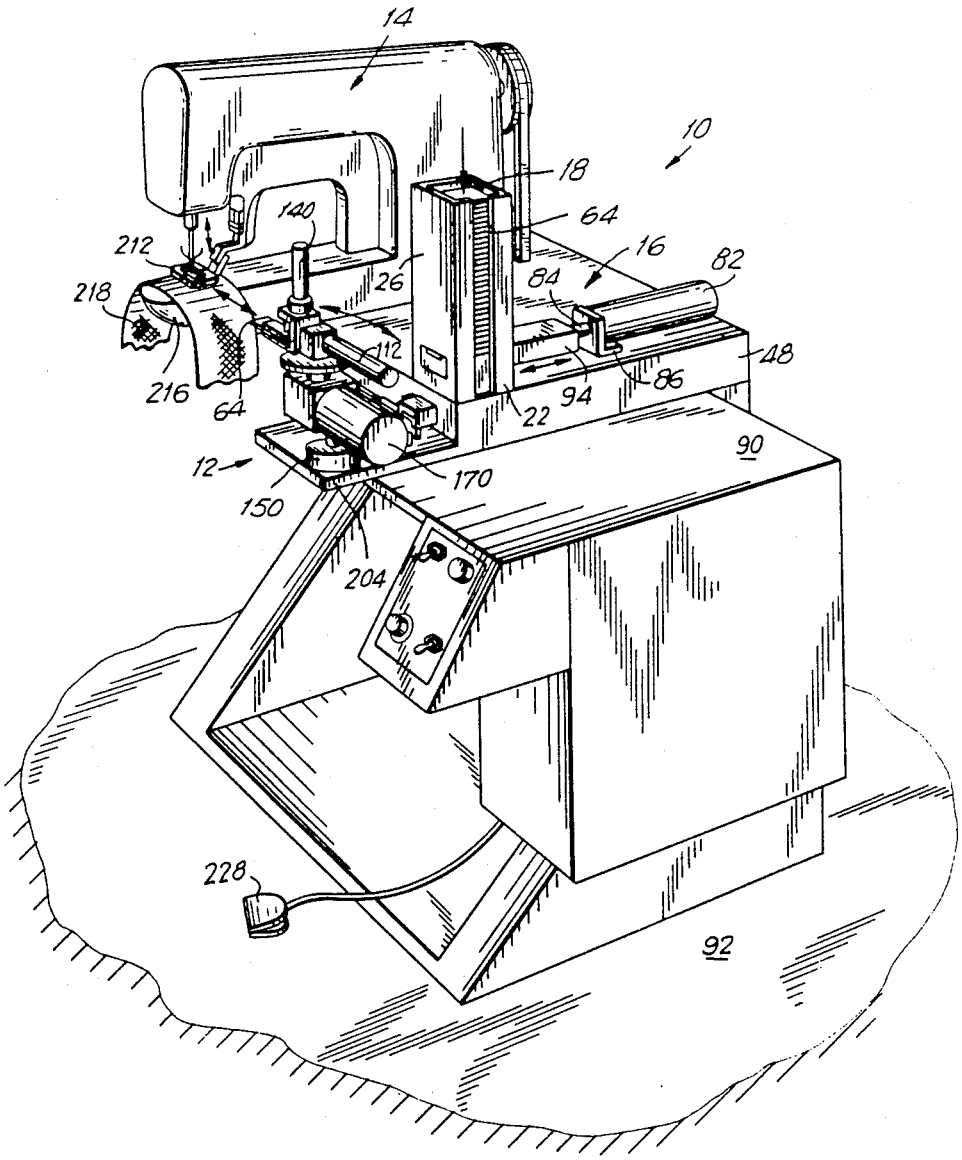
FIG. 1 is a perspective view of the small part feeding and inserting system according to the present invention, looking from an upper right vantage point.

Referring now in more detail to the drawings, wherein similar reference characters denote similar elements throughout the several views, a small part feeding and inserting system 10 including, without limitation, an insertion assembly 12 shown in FIG. 1 in combination with a sewing machine 14 and a magazine feeding assembly 16 from which a supply of precut items such as labels, for example, are supplied. It must be pointed out at the outset that while the insertion assembly 12 is shown in FIG. 1 in combination with magazine feed assembly 16, this same insertion assembly is capable of use with a continuous feed assembly as will be described with respect to FIGS. 22–31 below. It is this versatility and interchangeability that distinguishes the present invention from conventional apparatus. Similarly, the sewing machine with which portions of the present invention cooperate may be any one of a variety of machines available from manufacturers such as Singer and Union Special, by way of example.

Figure 12:
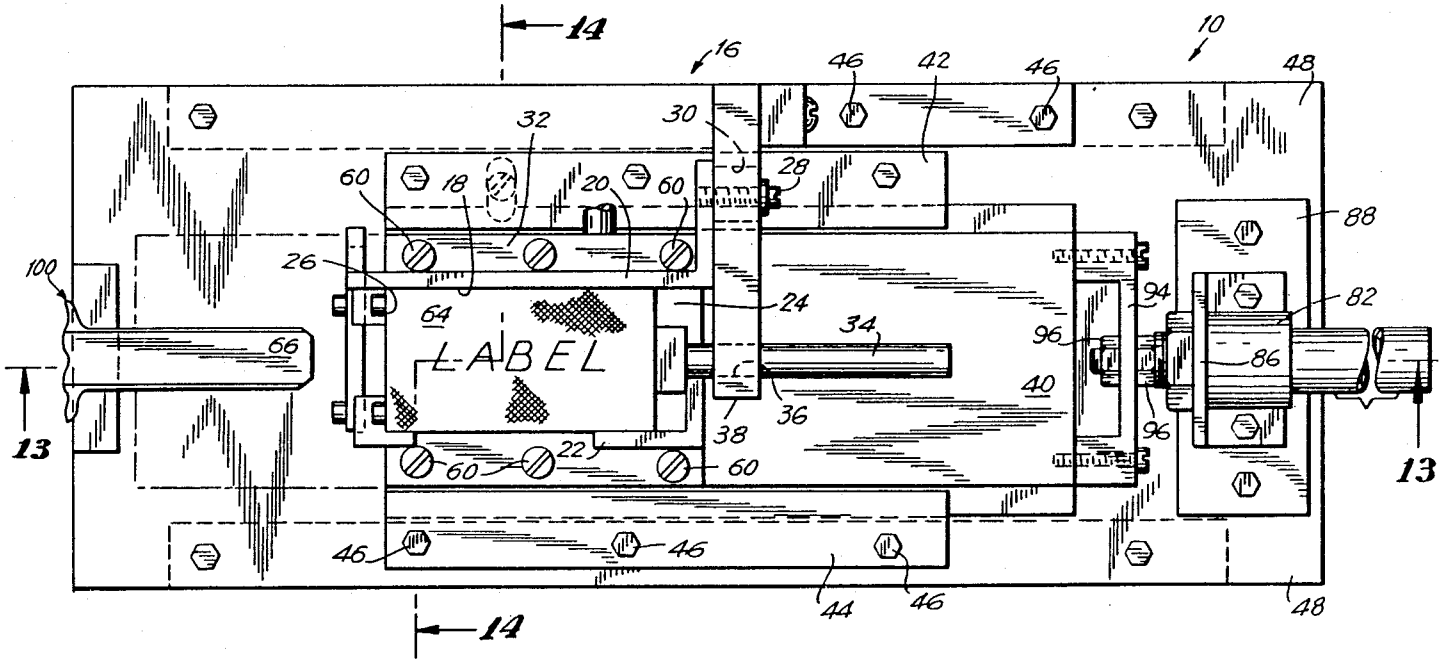
FIG. 12 is a fragmentary partial and enlarged top plan view of the label hopper and surrounding apparatus according to the present invention.

Magazine feed assembly 16, shown in top plan view in FIG. 12, includes a chamber 18 formed by pairs of side and front and rear walls. Side wall 20, unlike its optionally fixed opposite side wall 22, is adjustable within predetermined limits, and rear wall 24 is adjustable, unlike its opposite front wall 26. It is contemplated by the present invention that all four or any combination of these four walls may be adjustable, so as to accommodate a variety of sizes of labels or other items to be stacked within and fed from chamber 18. Adjustable side wall 20 is movable by means of a threaded set screw or bolt 28 which extends through oversized slot 30, such that positioning of wall 20 and its integral flange 32, and thereafter tightening of screw 28 will fix the wall in that position. In the case of adjustable rear chamber wall 24, a rotatable adjusting shaft 34 extends through a threaded opening 36 within flange 38, such that rotating shaft 34 in either direction will produce axial displacement and resulting movement of the rear wall 24 toward or away from front wall 26, thereby enabling the user to accommodate different lengths of labels.

Figure 13:
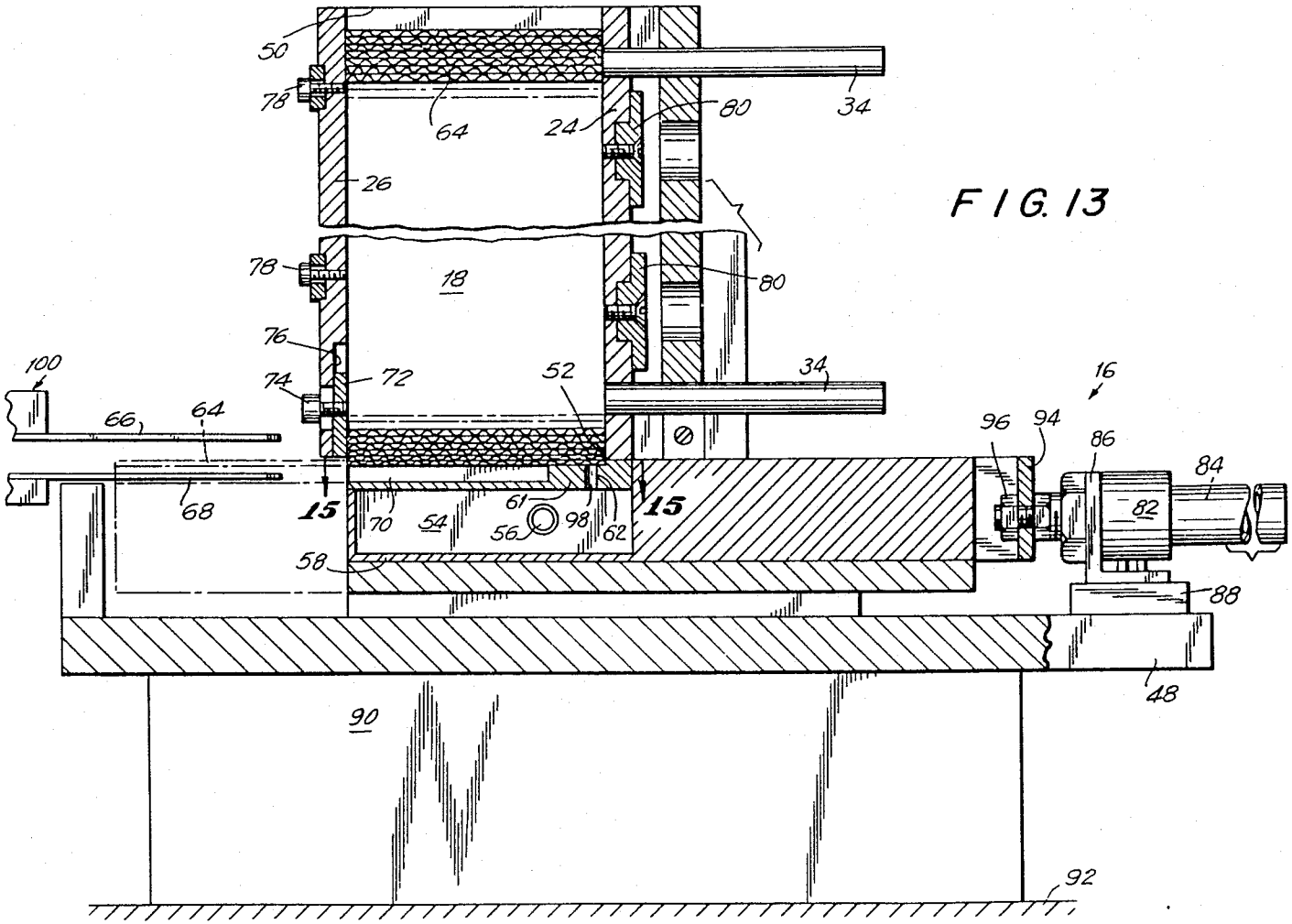
FIG. 13 is a fragmentary sectional elevational view taken along line 13—13 of FIG. 12.
Figure 14:
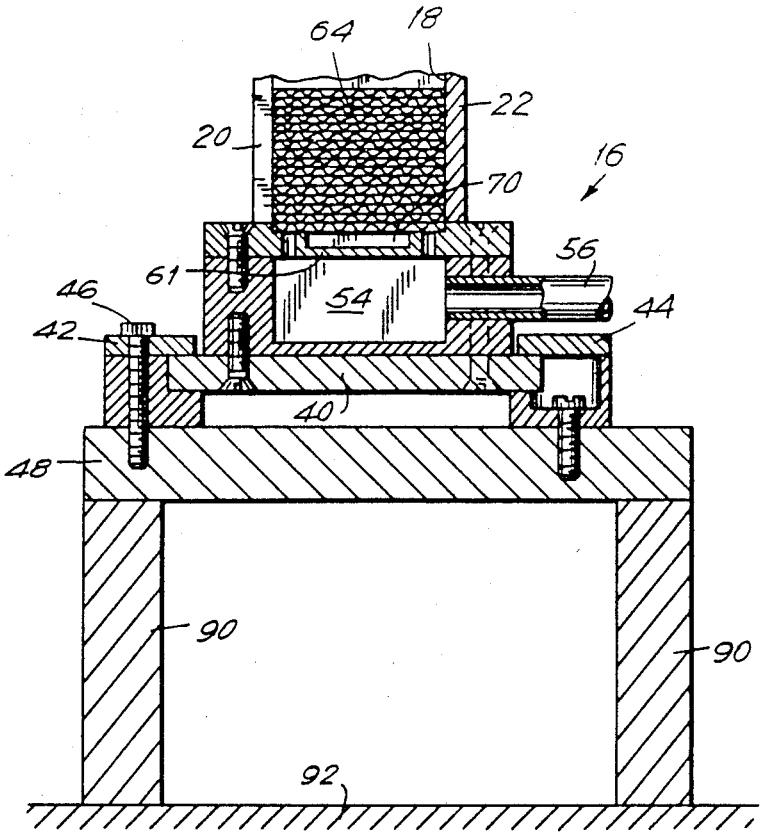
FIG. 14 is a fragmentary sectional elevational view taken along line 14—14 of FIG. 12.

As best seen in FIGS. 12, 13 and 14 a slide block 40 is supported for reciprocating movement beneath the wall structure defining label chamber 18. Opposing guide bars or rails 42 and 44 are secured by means of conventional fasteners 46, such as headed bolts, to a relatively fixed support bed or table 48. Guide rails 42 and 44 limit transverse movement of slide block 40 as it moves between the positions shown in full and phantom lines within FIG. 12, thereby serving an alignment function.

Chamber 18 serves as a label hopper within which labels to be sewn, for example, are stacked through the top opening 50 of this hopper. The bottom opening 52 of hopper or chamber 18 is in communication with a vacuum chamber 54, from which air is drawn through vacuum conduit 56 by conventional remote vacuum drawing apparatus that does not comprise the heart of the present invention. It is the lower pressure within vacuum chamber 54, relative to the atmospheric pressure, that results in a drawing downwardly of the stacked labels such that the bottommost latel extends beneath the rear wall 24 and in interfering relationship with respect to a label picker or stripper 58, in turn, is secured to slide block 40 by means of fasteners 60.

Picker 58 is formed with a platform to which a replaceable label nest insert 61 is secured by means of removable fasteners 63. Nest insert 61, in turn, is formed with an urging wall 62 which engages the rear edge of a label 64 and pushes the label upon forward movement of the slide blook 40 into a position between upper and lower transfer clamp jaws 66 and 68, respectively. A recess 70 is formed within uppwardly facing surfaces of nest insert 61 and provides a clearance space into which lower transfer clamp jaw 68 may enter and assume a position beneath the label 64 fed by the picker. Vacuum chamber 54 is defined by walls of picker 58.

Once the label 64 is so fed, the transfer clamp jaws 66 and 68 are closed so as to positively grip the label, and slide block 40 and its associated label picker 58 are retracted into a position where the next label can be urged forwardly toward the transfer clamp jaws. An adjustable blade 72, movably fixed by a set screw or clamp 74, is situated within a groove 76 formed within forward or front wall 26 at the bottom thereof, and may be adjusted to control the smooth and efficient dispensing of labels, one at a time, to the transfer clamp jaws. Front slide blocks 78 and rear slide blocks 80 are shown merely to illustrate an ability of the present invention to provide different means by which to adjust the walls of the label hopper.

A feed air cylinder 82 with its associated reciprocable piston 84 is supported by means of a suitable flange mount 86 atop support table 48 via a mounting block 88. Table 48, in turn, is supported by a base 90, which may be either movable or fixed to the floor 92. Movement of reciprocable piston 84 within cylinder 82 is translated to slide block 40 through a vertical mounting wall or flange 94 at the rear of the slide block. Conventional nuts 96 secure the piston to this flange 94.

Figure 15:
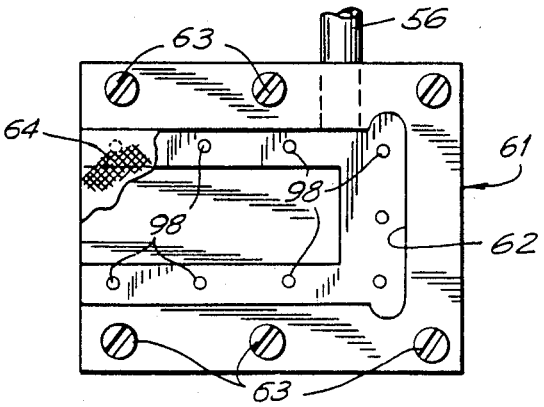
FIG. 15 is a fragmentary sectional plan view taken along line 15—15 of FIG. 13.

The lower pressure produced within vacuum chamber 54 draws air from beneath the bottommost label 64 in the label hopper by means of conduits 98 within label nest insert 61, which communicate with the vacuum chamber. This invention contemplates varying arrangements of conduits 98 and a variety of nest inserts which conform to the label utilized so as to reliably draw the label to the picker, as described and shown in FIG. 15 as well. This invention contemplates nest inserts of varying sizes and vacuum hole arrangements.

Figure 16:
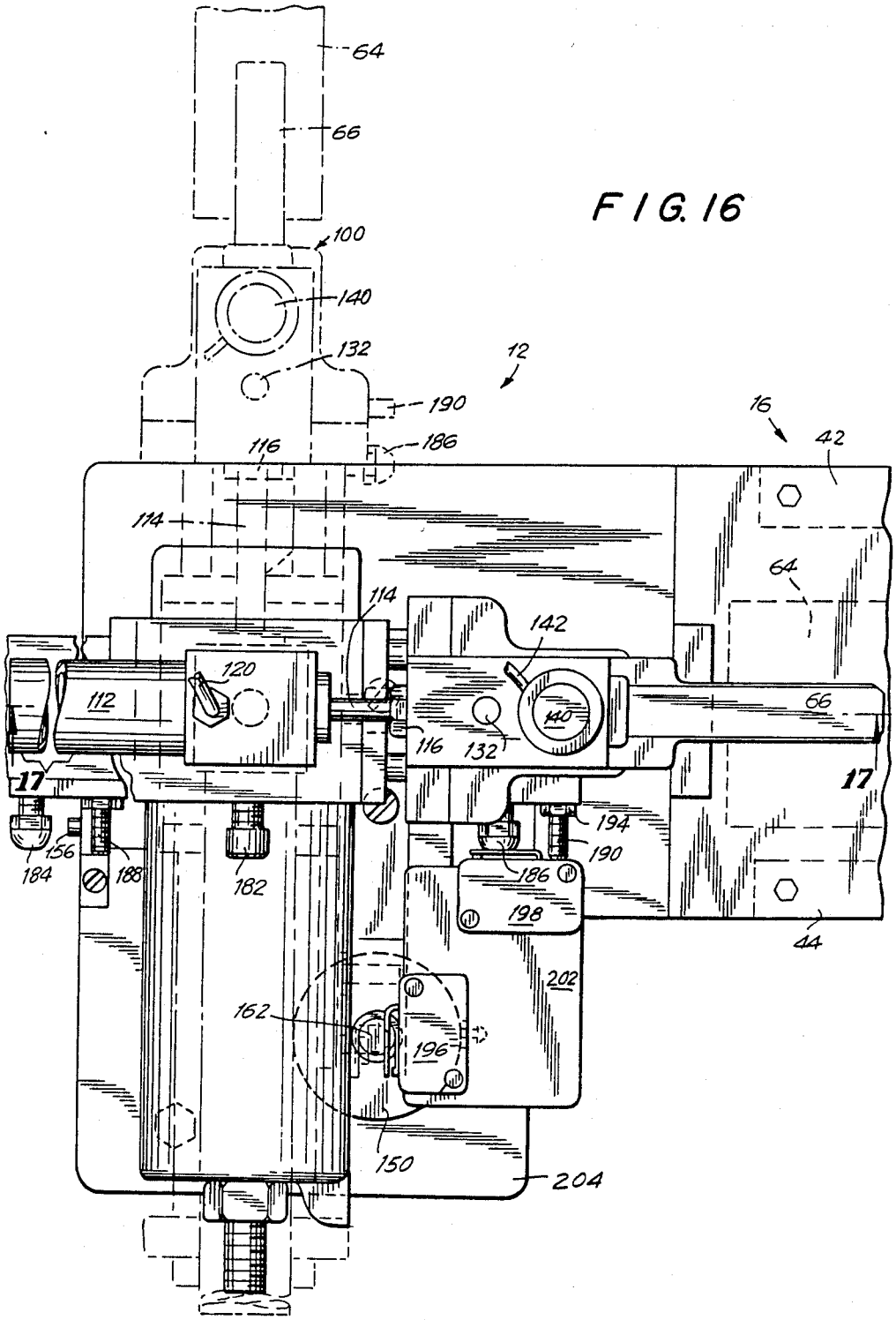
FIG. 16 is a fragmentary top plan view of a portion of the insertion assembly according to the present invention.

Having described the magazine feeding assembly 16, attention is now turned to the insertion assembly 12, which takes the label (or other small part) from the magazine feed assembly 16 (or continuous tape feed desribed below) and rotates such that the label or small part is thereafter inserted into a sewing or joining zone. FIG. 16 in a top plan view, and FIG. 17 in an elevational view, illustrate the insertion assembly 12 as including the upper and lower jaws 66 and 68, respectively, described above in conjunction with the magazine feed assembly. These jaws comprise part of a transfer clamp subassembly 100. Jaws or fingers 66 and 68 are supported in substantially horizontal disposition by means of fasteners 102 which hold each to respective upper and lower jaw support blocks 104 and 106. Lower jaw support block is substantially rigidly and immovably integral with the lower leg 108 of an insertion yoke 110 which, itself, is movable reciprocably as a result of forces transmitted to it from an insertion cylinder 112 through a connecting rod 114 attached to the piston (not shown) within cylinder 112. Connecting rod 114 is secured to insertion yoke 110 via lock nuts 116 on either side of central yoke wall 118. Thus, upon air pressure being applied to insertion cylinder 112 through air supply conduit 120, the piston and its associated connecting rod 114 move to the right as viewed within FIG. 17, urging yoke 110 and the entire transfer clamp subassembly 100 in the same direction. Alignment and control of this movement is accomplished by means of a guide rod 122 integral at its right end with yoke 110. A guide block 124 inhibits all but axial movement of guide rod 122, and the head of a threaded bolt 126 within threaded block 128 provides a stop, limiting movement to the left as shown in FIG. 17.

Upper leg 130 of yoke 110 and the yoke's lower leg 108 are formed with openings 132 in which a vertically extending guide rod 134 is situated. A spacer block 136 surrounds an upper portion of rod 134 between upper leg 130 of yoke 110 and upper jaw support block 104, thereby limiting upward movement of this upper jaw support block and its associated transfer clamp upper jaw 66. Block 104 is formed with a guide hole 138 through which guide rod 134 extends, and this invention contemplates the use of a plurality of such guide rods to maintain alignment and to control movement of the upper jaw 66.

Movement of upper jaw 66 is accomplished through a clamping cylinder 140 disposed atop upper yoke leg 130 and supplied by air through conduits 142. A bearing 144 accommodates piston rod 146 which, in turn, is connected at its lowermost end to jaw block 104 through hexagonal nut 148.

Figure 17:
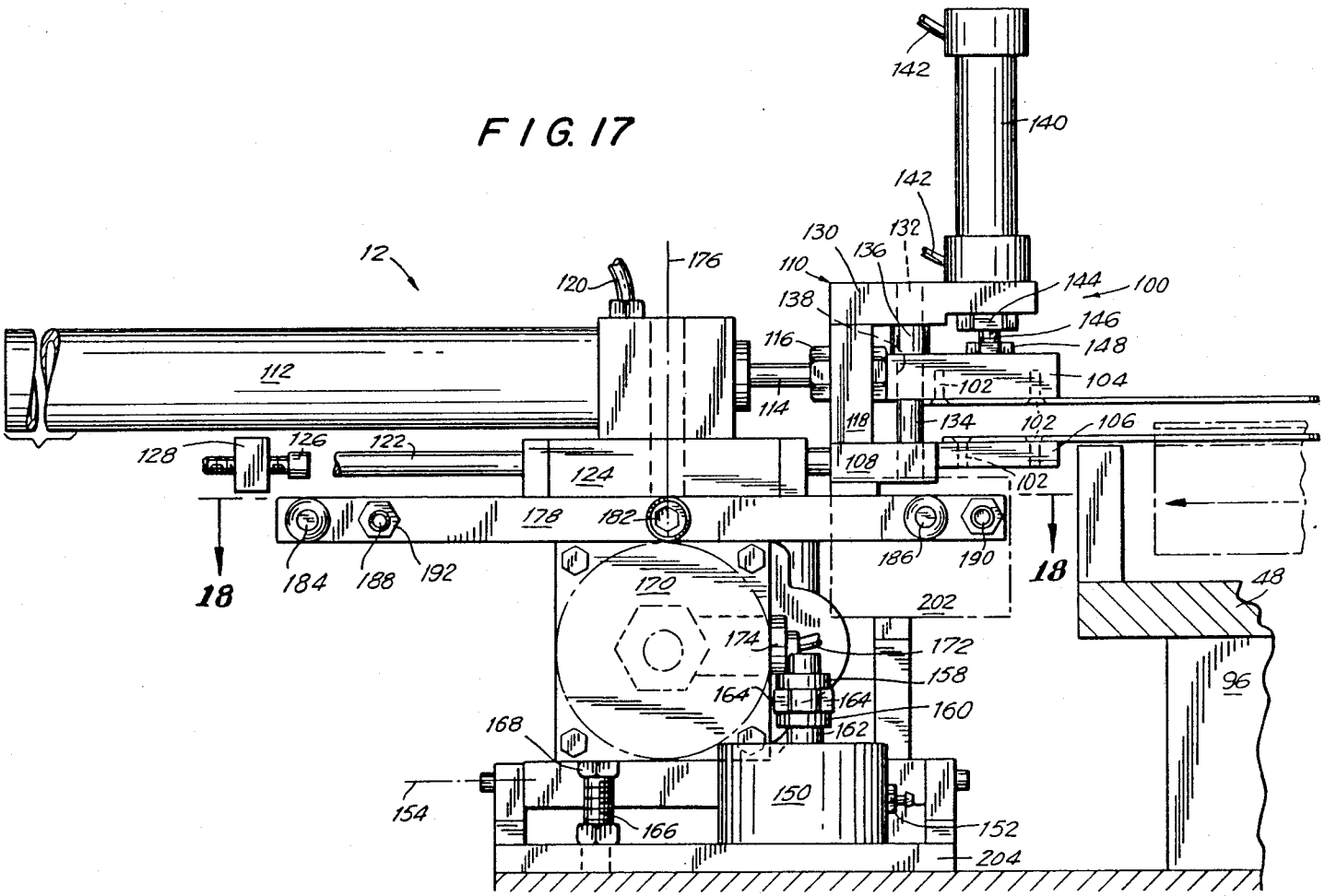
FIG. 17 is a fragmentary sectional elevational view taken along line 17—17 of FIG. 16.

What is referred to here as a duck or pancake air cylinder 150 is supplied air through its fitting 152, and serves the purpose of elevating and lowering the transfer clamp subassembly 100 and its associated components, shown in FIG. 17. This elevating and lowering is enabled by a pair of upper and lower flanges 158 and 160 on piston rod 162 associated with duck cylinder 150, the flanges engaging yoke arms 164 integral with the upper insertion assembly housing. Thus, upon actuation, piston rod 162 is extended or retracted, depending upon the time in the cycle, thereby elevating or lowering yoke arms 164 such that the upper insertion housing and its associated transfer clamp subassembly are moved. This up and down movement is limited through the provision of an adjustable stop in the form of a threaded rod 166 and its adjustable stop nut 168.

A rotary air cylinder 170 forms part of insertion assembly 12 and is fed via conduit 172 and fitting 174, as shown in FIG. 17. Rotary cylinder 170 serves the purpose of rotating the upper portions of insertion assembly 12 and the transfer clamp subassembly, so that the item that has been fed to the clamp jaws, such as a label, may be rotated away from the feed assembly 16 to the sewing area, all of this done within view of the operator so that a defect in the label or the manner in which it is held may be observed by the operator, enabling him or her to abort the sewing operation. Defects might include a seam or stain, for example, and another reason for the abort might be where the operator has not properly positioned the garment to which the label is to be attached in the time necessary for the next operation. The rotary movement caused by rotary air cylinder 170 occurs about a substantially vertical axis labelled reference character 176, and this very movement further serves to limit and control with microswitching the timing of operation. This will be explained in more detail below.

Figure 18:
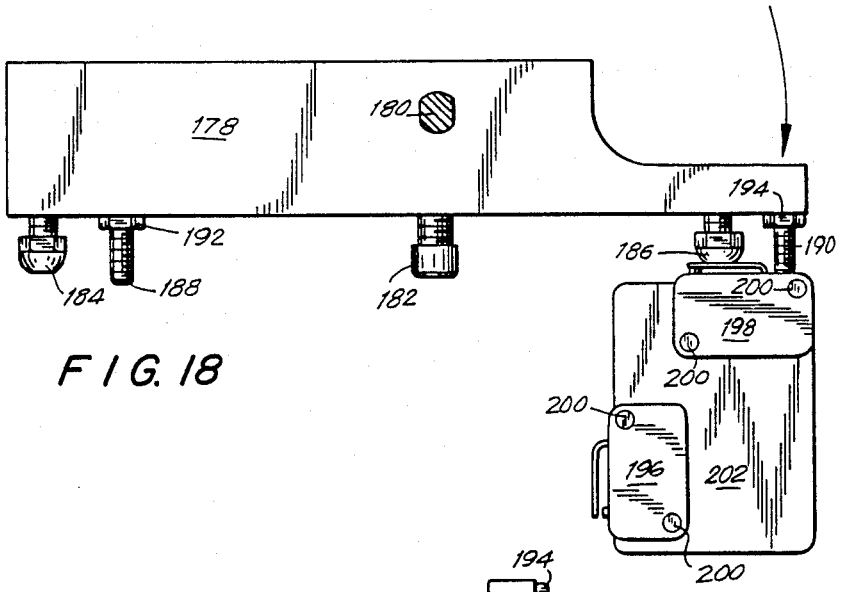
FIG. 18 is a sectional plan view taken along line 18—18 of FIG. 17.
Figure 19:
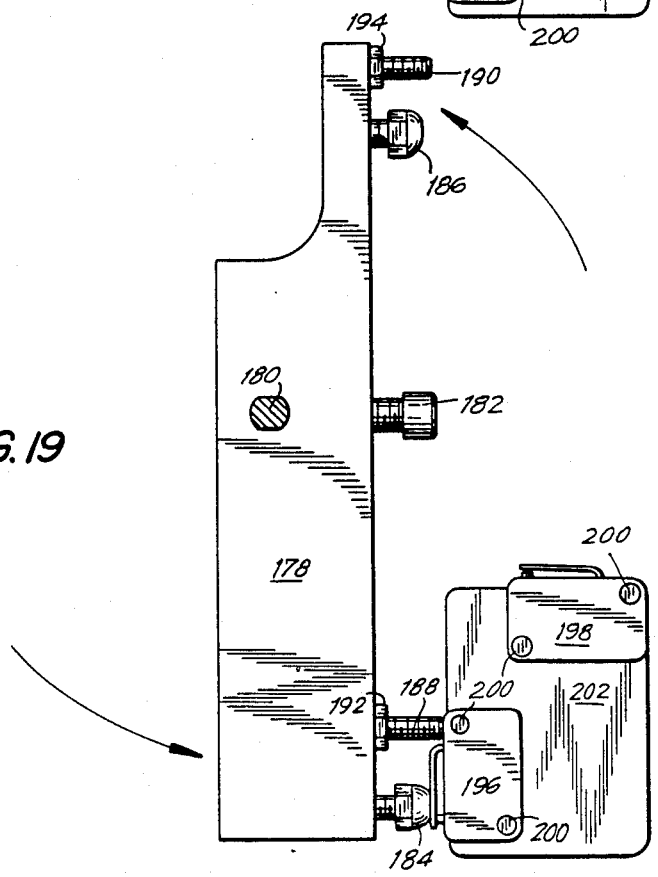
FIG. 19 is a view similar to FIG. 18, but illustrating the insertion slide and pivot subassembly pivoted ninety degrees from that shown in FIG. 18.

An insertion rotating block 178 is shown in FIG. 17 and in more detail in plan view FIG. 18. A keyed shaft 180 transmits the rotary forces from rotary cylinder 170 to block 178, and this shaft is held integral with the block by means of a set screw 182. Adjustable switch actuator buttons 184 and 186 engage threaded openings formed within block 178 and extend a preselected distance from the block. Stop rods 188 and 190 similarly engage threaded openings within block 178 and are held with their extremities a preselected and adjustable distance from the block by means of lock nuts 192 and 194, respectively.

Rotation of block 178 is controlled in part by means of microswitches 196 and 198, each of which is secured by fasteners 200 to a switch mounting plate 202 such that their respective actuators are aligned within the paths of actuator buttons 184 and 186. Axis 176 coincides with the axis of keyed shaft 180, for reference purposes. A base plate 204 is adapted to support duck cylinder 150 and its associated apparatus.

Figure 20:
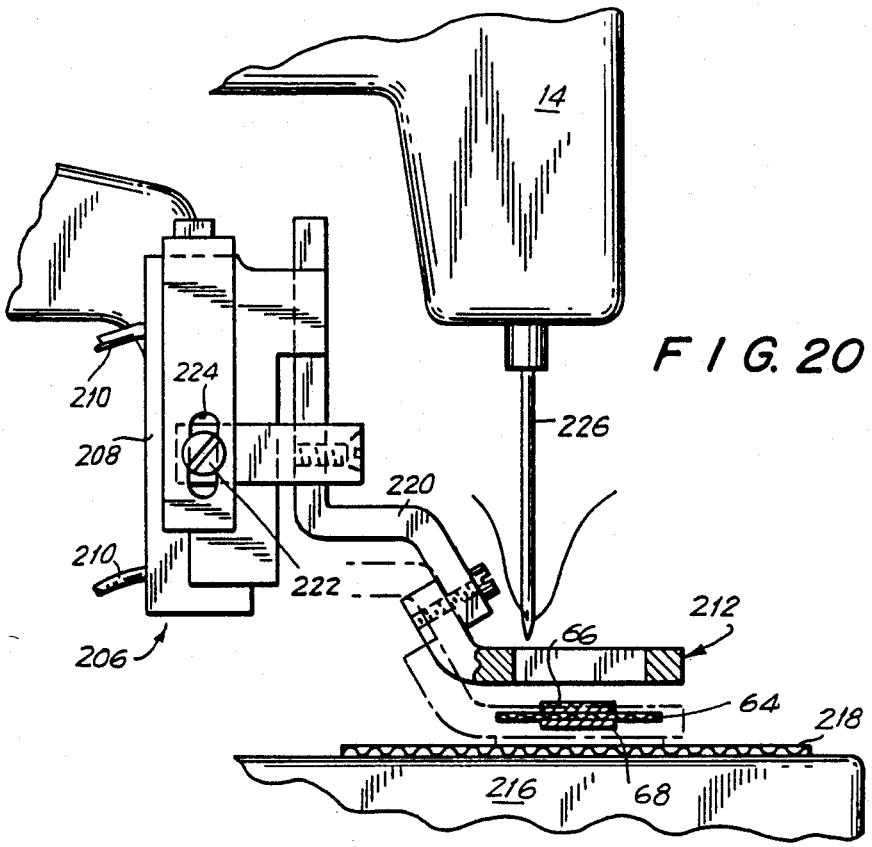
FIG. 20 is a partional fragmentary sectional elevational view of label clamping apparatus in the sewing zone.

At the sewing machine 14, a sewing or joining clamping assembly 206 is utilized to receive and hold the label, tape, Velcro or other item to be joined to a garment or other fabric. Clamping assembly 206 includes a pair of clamping air cylinders 208 fed by means of conduits 210. These air cylinders control left and right side sewing machine clamps 212, respectively, which hold portions of the label to be sewn to the garment. FIG. 20 illustrates in fragmentary elevation a portion of the sewing machine bed 216 upon which a portion of garment fabric 218 is depicted.

Figure 21:
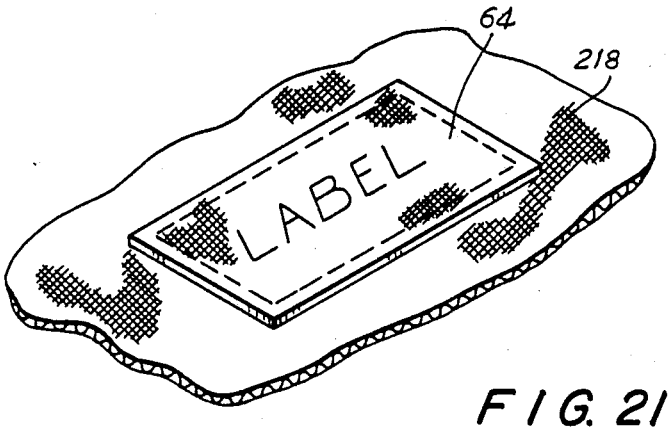
FIG. 21 is a partial perspective view of a label of the type capable of being fed and inserted according to the present invention.

Each of the left and right sewing machine clamps 212 is supported by a depending bracket 220 which, in turn, is supported by an air cylinder mounting which is adjustable by means of fasteners 222 within an elongated slot 224. The left clamp is substantially U-shaped, with the open end facing toward the right, while the right clamp is a substantial mirror image. The central opening formed by these left and right sided U-shaped sewing machine clamps provides clearance for the sewing needle 226 to enter and complete the sewing operation along the path shown in phantom in FIG. 21.

In operation, an operator normally sits at the system 10 as shown in FIG. 1 and, with his or her foot on foot pedal 228, orients or positions a work piece such as a garment fabric 218 over the sewing machine bed 216 within a sewing zone. For purposes of illustration, this description will commence at a point in the cycle where a label 64 has already been fed to jaws 66 and 68, as shown in FIG. 2, and the transfer clamp subassembly 100 has been rotated by means of rotating cylinder 170 to the position shown. Upon depressing the footpedal, sewing machine clamps 212 of clamping assembly 206 are raised to the position shown in full lines in FIGS. 3 and 20 and label 64 which at this point in the cycle is gripped between jaws 66 and 68 of the transfer clamp subassembly 100 is transferred or advanced to the sewing zone or station, whereupon duck cylinder 150 lowers the label to the surface of work piece 218.

During this transfer, the label will not drag along the work piece due to the elevation of the label established by duck cylinder 150, which keeps the label along a relatively horizontal path at a relatively higher elevation and, once over the workpiece, moves it downwardly. FIG. 3 illustrates in phantom lines the transferred label 64 and beneath that in phantom the label 64 upon work piece 218. FIG. 4 illustrates in top plan view the label transferred, with connecting rod 114 extended from insertion cylinder 112 in the direction of the arrow.

At this point, shown in FIG. 5, left sewing machine clamp 212 is lowered in the direction of the arrow, until it comes into contact with label 64 and holds same against work piece 218. The upper transfer clamp jaw 66 is raised in the direction of the arrow of FIG. 5 now that the label 64 is held by the left sewing machine clamp, and thereafter insertion cylinder 112 is actuated to retract the jaws 66 and 68 from the sewing zone in the direction of the arrow of FIG. 6, and the right sewing clamp 212 is lowered by cylinder 208 from the position shown in phantom lines in FIG. 7 in the direction of the arrow to the position shown in full lines so that the label is firmly held around its perimeter for sewing. Duck cylinder 150, in the meantime, is actuated to raise the transfer clamp assembly 100 while the insertion cylinder 112 is retracted, and while sewing is started.

Figure 8:
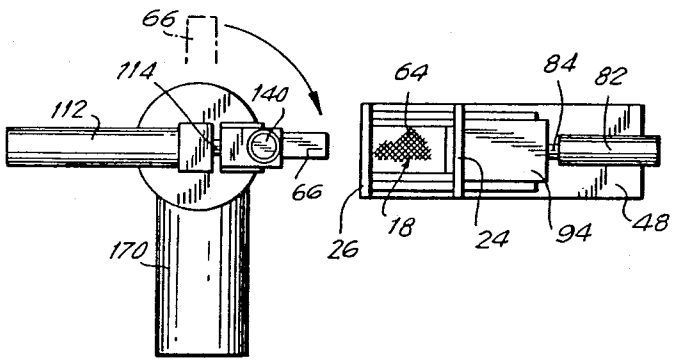
Figure 9:
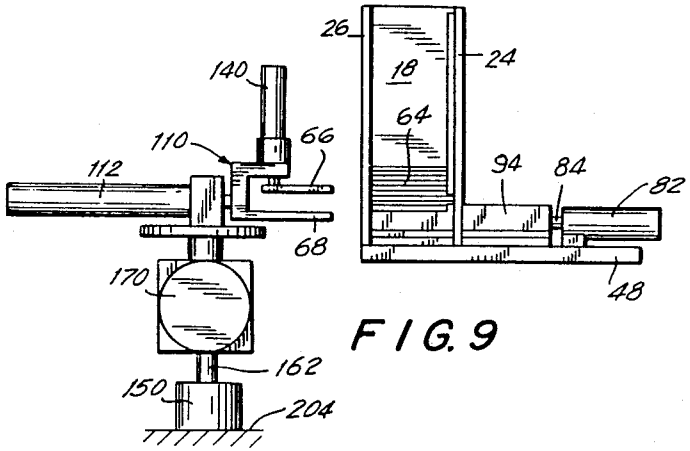

After sewing has commenced the rotating cylinder 170 is actuated and causes the transfer clamp assembly to rotate in the direction of the arrow from the position shown in phantom lines within FIG. 8 to that of full lines therein where, with jaws 66 and 68 open (jaw 66 is raised), the jaws are ready to receive the next label 64. FIG. 9 illustrates in elevational view the apparatus shown in plan view in FIG. 8.

Figure 10:
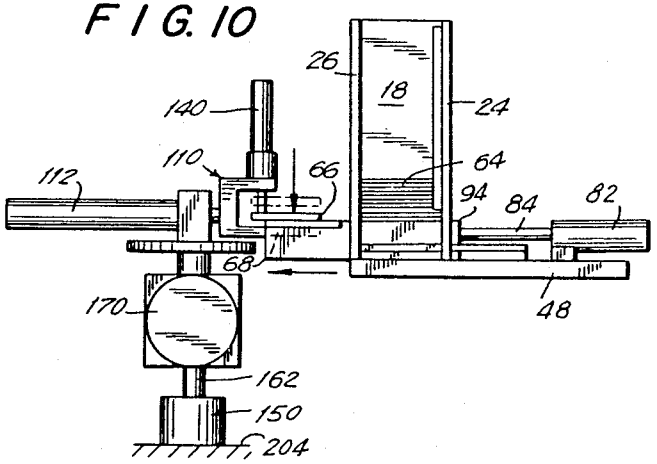
Figure 11:
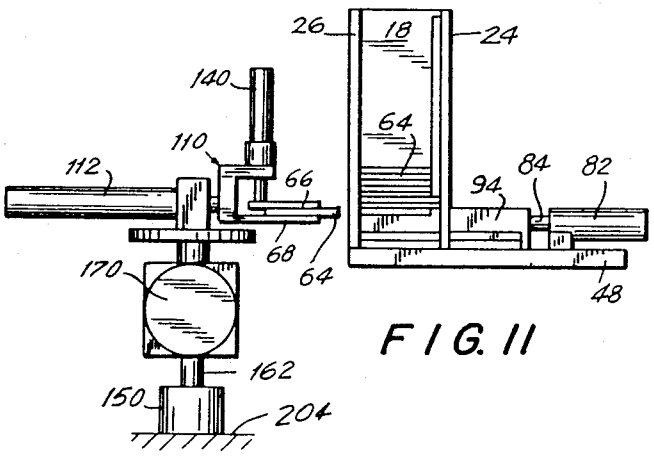

FIG. 10 illustrates the next step, wherein a single label 64 drawn downwardly within label hopper or chamber 18 by vacuum to the nest or recess defined by the label nest insert within label picker 58 is fed by means of movement of slide block 40 under the influence of feed air cylinder 82 to a position shown in phantom lines in FIG. 13 and in full lines within FIG. 10. Upper jaw 66 is thereupon lowered under the influence of actuated clamping cylinder 140, thereby gripping label 64. FIG. 11 illustrates in elevation the label now held between jaws 66 and 68. At this point in the cycle, the gripped label is rotated by rotating cylinder 170 to position shown in FIG. 2, whereupon it is ready for insertion upon actuation of the foot pedal 228.

Thus, the operator has sewn a label that has been fed from the magazine feeder to a garment, and another garment in a series can be positioned and readied for the next label. The operator's hands have only had to deal with the garment or work piece, with the feeding and transfering of the label being automatically accomplished by the system of the present invention via a simple foot pedal. Air cylinders, responsive to a control circuit, correctly and efficiently and sequentially, control the mechanical movements necessary to carry out the steps described to perform the label stitching shown in phantom lines in FIG. 21.

Figure 24:
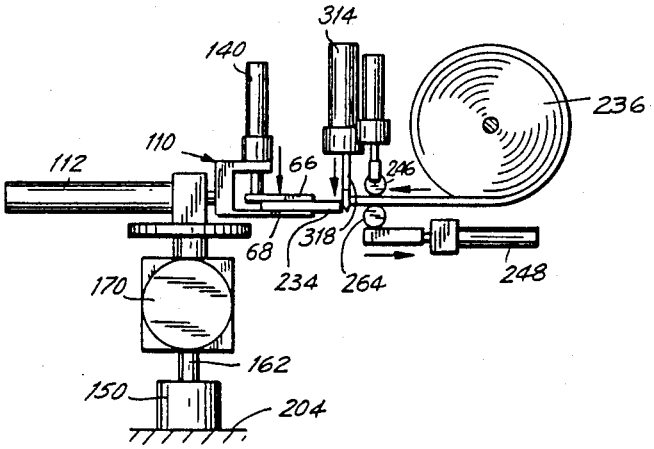
FIG. 24 is a view similar to FIG. 23, illustrating tape as having been fed and cut.

At this point within this specification, attention is directed to an alternative feeding arrangement according to the present invention—an alternative to the magazine feeding arrangement just described. More specifically, and by way of example, small parts in the form of tape strips such as velcro are fed to the insertion portion of this invention. FIG. 24 in a top plan view illustrates, in combination, a continuous feed assembly 232 in cooperative relationship with insertion assembly 14, wherein strips 234 of tape of preselected size and shape are fed from a relatively continuous feed roll in a controlled manner and are cut from this feed roll by means of a knife subassembly 238. Reference is made at this point to prior inventions embodied within patents of record in the name of Charles Block, named either alone or as a co-inventor to appreciate the state of the art known to applicant.

Tape material, such as Velcro, is fed from feed roll 236 which is releasably held upon a reel 240 journalled upon shaft 242 held for rotation between movable locator blocks 244. The tape is advanced via the pulling action of knurled roller 246 driven by feed cylinder 248 through a one way clutch 250 upon shaft 252 and thereafter via timing belt 254 interconnecting shaft 242 with shaft 256 upon which knurled roller 246 is mounted. The tape is fed between a pair of guide pins 258 and 260 and platform 262 to the underside of knurled roller 246 where it is held tightly against the roller 246 by means of pressure roller 264 which, in turn, is biased upwardly as viewed in FIG. 27 by a helical spring 266 compressed between a spring plate 268 and base platform 270. The ends of spring 266 are held in place by fasteners 272, and spring plate 268 supports pressure roller 264 through a roller shaft 274. A pressure release finger lever 276 facilitates removal of the pressure roller 264 from against knurled roller 246. Spring plate 268 is supported at its right end as viewed in FIG. 27 on a pivot shaft 278 which, in turn, is journalled within a yoke of a bearing block 280 situated atop base platform 270.

Figure 25:
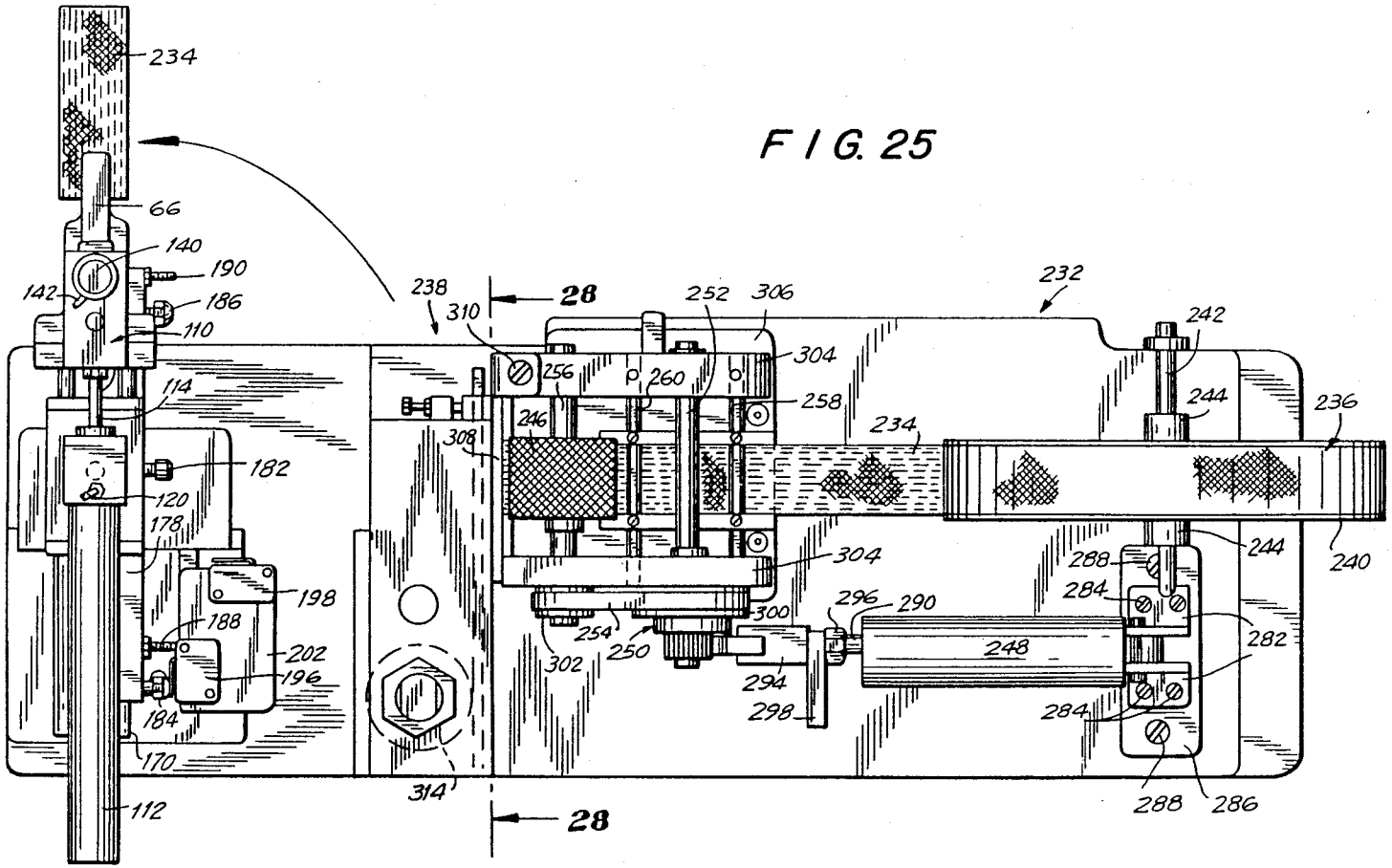
FIG. 25 is a top plan view of the continuous feed mechanism in relationship to the pivotable insertion assembly according to the present invention.
Figure 26:
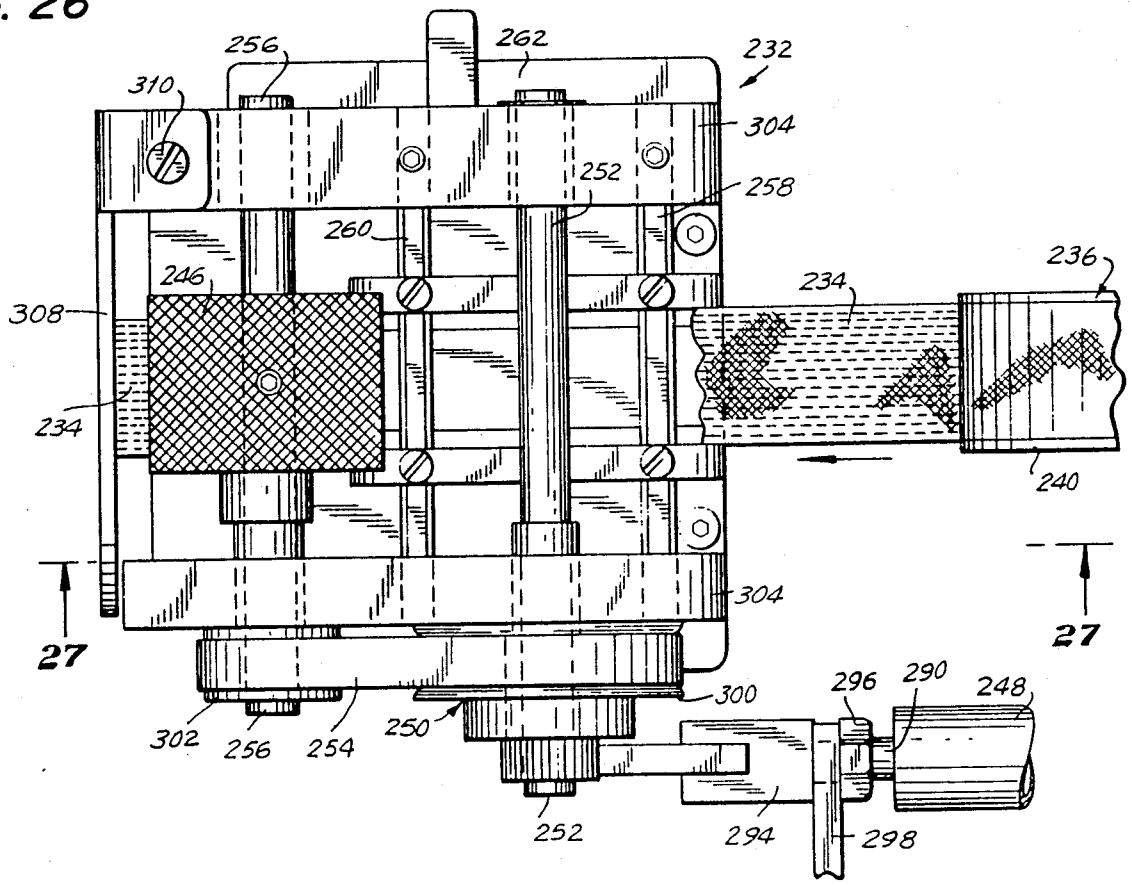
FIG. 26 is an enlarged fragmentary top plan view of a portion of the continuous feed mechanism.
Figure 27:
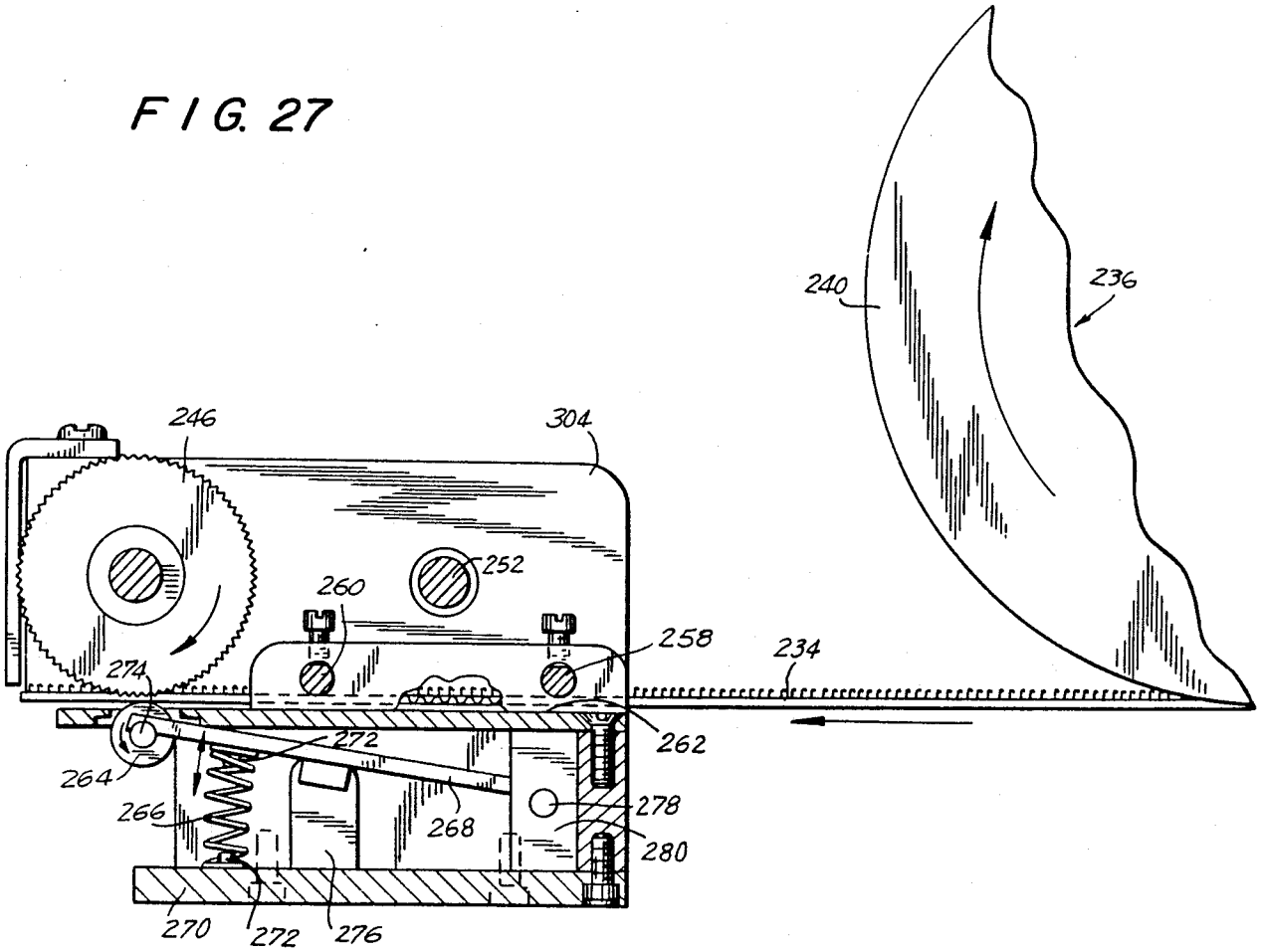
FIG. 27 is a fragmentary sectional elevational view taken along line 27—27 of FIG. 26.

As best seen in FIGS. 25 and 26, continuous feed cylinder 248 is pivotally supported at its right end through opposing flanged brackets 282 secured to base platform 270 with fasteners 284 which are threaded into intermediary pivot plate 286 which itself is secured by fasteners 288 to the platform. At its left end, the connecting rod 290 associated with a piston 292 within cylinder 248 is secured to a clevis 294 by means of lock nut 296, movement of clevis 294 being limited by clevis stop bar 298. Reciprocating movement of piston 292 causes one way turning of feed timing belt 254 which is supported upon pulleys 300 and 302 upon shafts 252 and 256, respectively. These shafts are journalled within clutch bearings (not shown) supported by upstanding flanges 304 of a base plate 306. A tape guard 308 is held in place by fastener 310 through a flange 304 adjoining knife subassembly 238 described below.

In operation, actuation of cylinder 248 causes knurled roller 246 to rotate a selected angle, thereby advancing tape of feed roll 236 on a path through knife subassembly 238.

Figure 29:
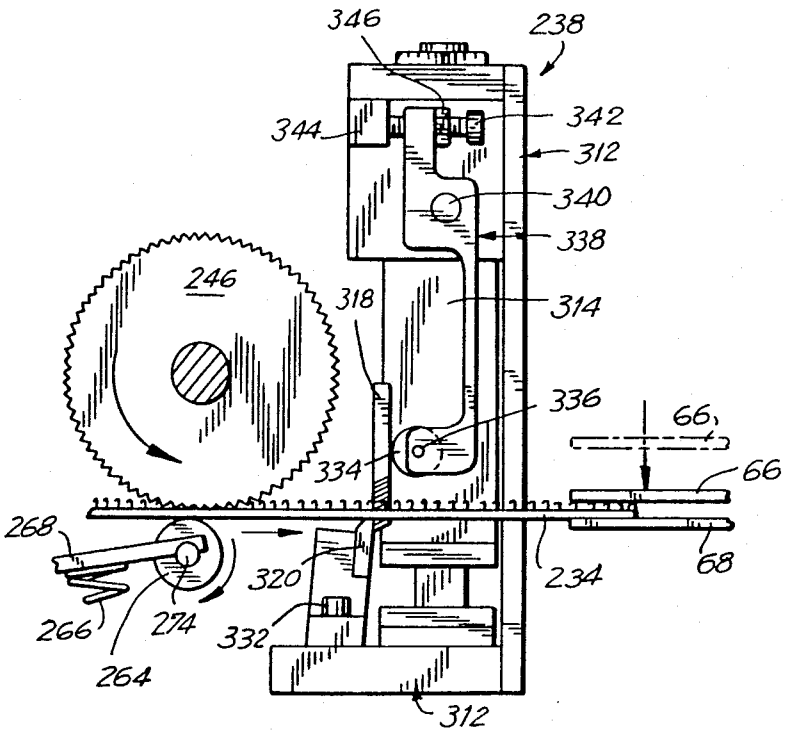
FIG. 29 is an elevational view looking along line 29—29 of FIG. 28.
Figure 28:
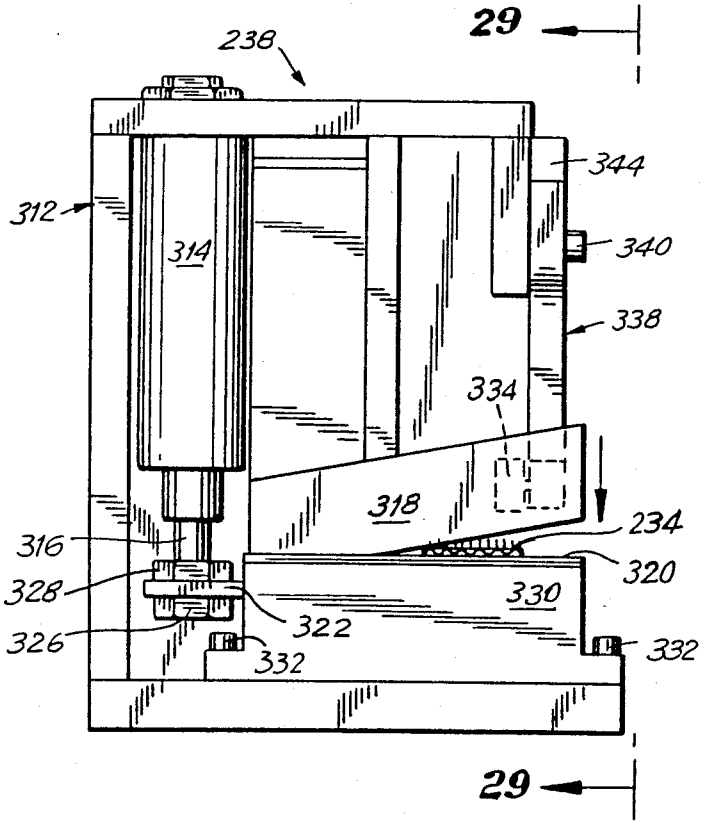
FIG. 28 is a fragmentary sectional elevational view taken along line 28—28 of FIG. 25.

Knife subassembly 238, best seen in FIGS. 28 and 29 (and partially within FIG. 25) serves the purpose of cutting the preselected lengths of tape 234 from roll 236 which has been fed by feed assembly 232. A knife support frame 312 supports a knife air cylinder 314 vertically with its piston 316 connected through an arm 322 held to connecting shaft 324 by connect and jam nuts 326 and 328, respectively, to a reciprocally movable knife blade 318 cooperative with a stationary or fixed knife blade 320. Fixed knife blade 320 is held in place by an anvil 330 bolted by bolts 332 to frame 312

A movable knife spring assembly holds blade 318 in preselected alignment through force exerted against blade 318 by ball bearing 334. Bearing 334 is mounted via dowel pin 336 to the bottom leg of a spring arm 338 which, in turn, is pivotally supported on and about shoulder screw 340 threaded into the frame 312. Pressure upon blade 318 is controlled by adjustment of socket headed cap screw 342 within boss 344 and locked by lock nut 346.

In operation, actuation of knife air cylinder 314 results in downward movement of movable blade 318 such that tape of continuous feed roll 236 that has been advanced by feed assembly 232 to the position shown in FIGS. 28 and 29 is severed by the cutting action between blades 318 and 320. At the time of this cutting off of a tape strip 234 from continuous roll 236, the jaws 66 and 68 of insertion assembly 12 have been rotated to the position shown in FIG. 29, with upper jaw 66 having been dropped in the direction of the arrow from the position shown in phantom outline within that view to that of full lines, as has been described above, thereby gripping tape strip 234 in much the same way as has been described for label 64.

In operation, continuous feed assembly 232 advances tape from continuous feed roll 236 to knife subassembly 238 by actuation of feed cylinder 248 which, through one way clutch 250 and the feed belt 254, causes knurled roller 246 to turn, thereby pulling the tape until it protrudes a predetermined length between movable and fixed knives 318 and 320 to and between jaws 66 and 68 of transfer clamp assembly 100. Knife cylinder 314 is actuated after upper jaw 66 is lowered to grip tape strip 234, thereby severing this strip from the continuous roll, and the transfer clamp assembly 100 is free to rotate the tape strip to a position where it will be inserted within the sewing zone or station.

Figure 22:
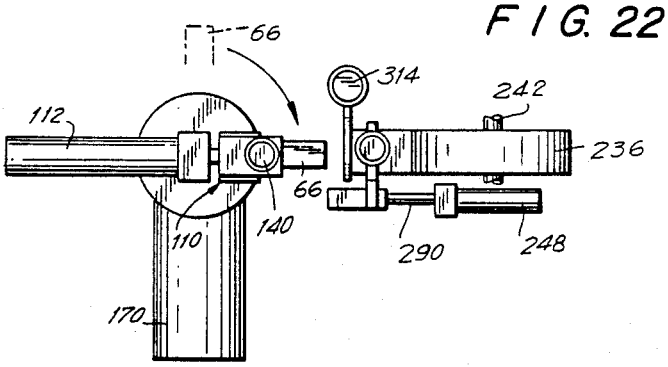
FIG. 22 is a top plan representational view of the continuous feed and pivotable insertion apparatus according to the present invention.
Figure 23:
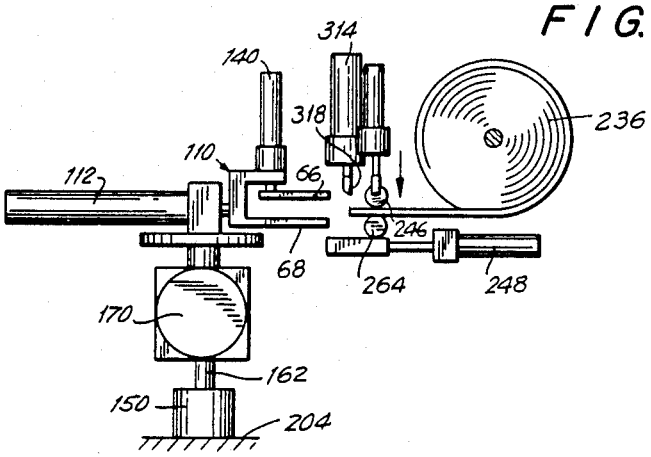
FIG. 23 is a front elevational view of the apparatus shown in FIG. 22.
Figure 30:
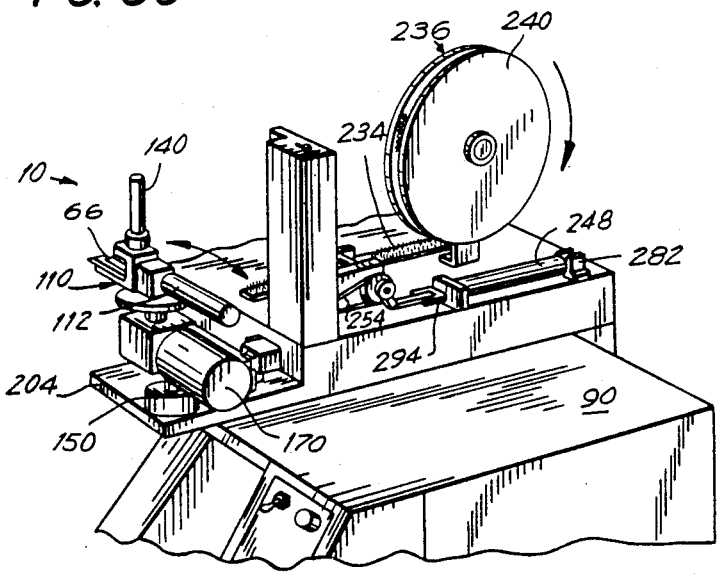
FIG. 30 is a fragmentary perspective view of the continuous feeding and cutting assembly according to the present invention.
Figure 31:
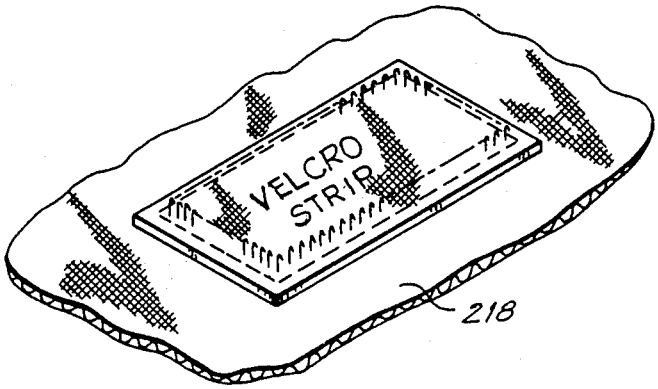
FIG. 31 is a partial perspective view of a cut piece of previously continuously fed tape, sewn to a garment.

FIG. 22 illustrates the rotating position of the transfer clamp subassembly 100 under the influence of the rotating cylinder 170 to a position where it can accept tape from the continuous feed assembly 232. FIG. 23 illustrates the apparatus of FIG. 22 in elevational view. FIG. 24 illustrates the advancing of the tape, the closing of upper jaw 66 and the lowering of upper knife blade 318, as described. FIG. 30 illustrates the rotation of transfer clamp assembly 100 after accepting the tape strip 234, while FIG. 31 illustrates tape strip 234 upon garment 218 and sewn along the phantom lines adjacent the periphery of the label.

The embodiments of the present invention particularly disclosed are presented merely as examples of the invention. Other embodiments, forms and modifications of the invention coming within the proper scope of the appended claims will, of course, readily suggest themselves to those skilled in the art.

What is claimed is:

1. A method of joining a first object to a second object, the steps comprising, in combination:

positioning a first object within said joining zone, causing a second object to be moved to a pickup zone, moving transfer clamp means to said pickup zone, causing said transfer clamp means to accept and hold said second object, causing said transfer clamp means to transfer said second object from said pickup zone to an insertion zone, causing said transfer clamp means to insert said second object into a joining zone, clamping a left side of said second object against said first object positioned within said joining zone, causing said transfer clamp means to release said second object and to move from said joining zone, and joining said first and second objects, said step of causing a second object to be moved to a pickup zone including imposing reduced air pressure to one side of said second object, thereby causing a flattening and relative stiffening of the second object prior to its acceptance by said transfer clamp.

2. The method of claim 1, wherein said step of reducing the air pressure includes drawing air through perforations formed in a nest insert by vacuum means.

* * * * *